US006408487B1

(12) United States Patent
Atkinson

(10) Patent No.: US 6,408,487 B1
(45) Date of Patent: Jun. 25, 2002

(54) CARD WIRE, ESPECIALLY FOR DOFFERS AND WORKERS

(75) Inventor: Kenneth Ross Atkinson, Highton (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 0 days.

(21) Appl. No.: 09/806,841

(22) PCT Filed: Oct. 28, 1999

(86) PCT No.: PCT/AU99/00935

§ 371 (c)(1),
(2), (4) Date: May 1, 2001

(87) PCT Pub. No.: WO00/26450

PCT Pub. Date: May 11, 2000

(30) Foreign Application Priority Data

Oct. 30, 1998 (AU) ..... PP6810

(51) Int. Cl.[7] ..... D01G 15/84
(52) U.S. Cl. ..... 19/114; 19/98
(58) Field of Search ..... 19/98, 100, 101, 19/102, 104, 105, 106 R, 108, 110, 111, 112, 113, 114, 115 A, 115 R, 128, 215, 217, 233

(56) References Cited

U.S. PATENT DOCUMENTS

| | | | | | |
|---|---|---|---|---|---|
| 2,937,413 | A | * | 5/1960 | Hollingsworth | 19/114 |
| 4,653,152 | A | | 3/1987 | Wada | |
| 4,953,264 | A | * | 9/1990 | Hollingsworth et al. | 19/114 |
| 4,964,195 | A | * | 10/1990 | Hollingsworth | 19/114 |
| 5,581,848 | A | * | 12/1996 | Egerer | 19/114 |
| 5,755,012 | A | * | 5/1998 | Hollingsworth | 19/114 |

FOREIGN PATENT DOCUMENTS

FR 1484526 6/1966

OTHER PUBLICATIONS

International Search Report.

* cited by examiner

*Primary Examiner*—Danny Worrell
*Assistant Examiner*—Gary L. Welch
(74) *Attorney, Agent, or Firm*—Merchant & Gould PC

(57) ABSTRACT

Card clothing comprises a strip of profile wire having a plurality of longitudinally aligned teeth (110) with respective overhanging tips (111). The edge-face (112) of each tooth under the overhanging tip includes at least one undercut edge-segment (114) spaced along the edge-face from the tip. This undercut edge-segment increases the retention of fibres by the edge-face during carding.

21 Claims, 5 Drawing Sheets

Plot of the decay of fibre on the swift showing the increased efficiency of the new profile Hauteur against production density on the swift for the two wires

CARD WIRE, ESPECIALLY FOR DOFFERS AND WORKERS

FIELD OF THE INVENTION

This invention relates generally to card clothing, and is concerned in particular with enhancing the efficiency of fibre transfer to doffers and workers during textile carding.

BACKGROUND ART

A critically important aspect of carding is the efficiency of transfer of fibre from the main cylinder, or swift, to the doffer. Low transfer efficiency leads to excessive recycling of fibre around the swift, which in turn decreases the quality of the product through increased fibre breakage and the incidence of nep in the web. In worsted processing, this increased fibre breakage results in a reduction of the average fibre length or hauteur in the combed wool product. Doffer wire is designed and manufactured specifically to maximise the transfer efficiency by ensuring that the working angles are optimised and that the points of the teeth are sharp. The lifetime of the wire is maximised by appropriate metallurgy and heat treatment of the wire during manufacture.

The workers on cards function in the same way as doffers and the technology described herein, so far as it relates to doffer wire, applies equally to worker wire.

Disclosures of metallic card clothing are to be found in U.S. Pat. Nos. 4,964,195, 5,581,848 and 5,755,012. U.S. Pat. No. 4,964,195 describes a card wire in which, in order to improve the carding action, the teeth are formed to have hooked tips to open up neps. This hooked tip has a flat top and a convex underside to the straight inside edge of the tooth, although the corresponding commercial product has an underside of the tooth that is flat or nearly flat and inclined to the wire base. The flat top is thought to act as a fibre deflecting surface and so reduce the total opening available to receive the fibres between the teeth. U.S. Pat. No. 5,581,848 describes a combing or carding tooth with a second tip in the combing front edge.

Another known wire for carding applications has longitudinal grooves cut on both sides of the teeth. This wire is called "serrated" wire, and its object is to improve the doffing of slippery fibres by providing a notch in the sides of the tooth that prevents the fibres slipping off the pins. Tests by the present applicant have shown that it is of quite limited value for this purpose, even where the grooves are of rectangular cross-section and relatively deep.

FIG. 1 illustrates the successive stages in the transfer of a longer fibre 8 from a swift 4, indicated at the left, to a doffer 6. Successive positions of the fibre 8 are depicted at a to g. The arrows 4*a*, 6*a*, show the directions of rotation. Once a fibre loops around a doffer tooth 7, it is subsequently straightened (position a) and held under tension by the teeth 5 of the swift 4 because of the much higher surface speed of the swift and the forward angle of the teeth. Given that the fibre on the doffer is under tension, the position evolves to one in which the fibre is normal to the surface of the doffer, provided the doffer tooth can hold the fibre. The actual angle achieved depends on the magnitude of the coefficient of friction between the fibre and the respective metal wires.

Previous analyses of doffer wire efficiency have emphasised the effectiveness of fibre pick-up and have ignored the effect of fibre loss from the pins, which will ultimately determine the level of transfer efficiency. For a doffer operating at equilibrium running conditions, the smaller the transfer efficiency to the doffer, the thicker the layer of recycled fibre on the swift, and the smaller the grip of the teeth of the swift on the fibre held by the doffer. In turn, this reduces the tension in the fibre and increases the chance that the fibre will be retained by the doffer. In effect, doffers rely on recycled fibre to reduce the grip of the pins of the swift so that transfer from the swift can occur. Thus, doffer efficiency is a dynamic function of the design of the doffer wire and the nature of the fibre being processed.

An object of this invention, at least in one application, is to increase the efficiency with which fibres are transferred from the swift to the doffer. The invention also has application to the design of worker wire because workers operate in exactly the same way as doffers.

SUMMARY OF THE INVENTION

The invention essentially entails the concept that enhanced fiber transfer efficiency can be achieve by forming one or more undercuts on the forward or inside face of the overhanging teeth or carding wire on the take-up component in a card transfer stage. The one or more undercut preferably includes a portion substantially parallel to the longitudinal direction of the wire, ie the peripheral surface of the cylindrical structure on which the wire is wrapped.

The invention accordingly provides card clothing comprising a strip of profile wire having a plurality of longitudinally aligned teeth with respective overhanging tips, wherein the edge-face of each tooth under the overhanging tip includes at least one undercut edge-segment spaced along the edge-face from the tip, which undercut edge-segment increases the retention of fibres by said edge-face during carding.

Preferably, there are a plurality of said edge-segments spaced apart and from said tip along said edge-face.

Advantageously, there are multiple undercut edge-segment in said edge-face and the spacing of these edge-segments increases in a direction away from the tip of the tooth.

In an embodiment, each of the edge segments has an extremity in the longitudinal direction of the profile wire, and these extremities of the edge segments and the tip are in alignment.

In one arrangement, the edge-face includes a tip portion adjacent said tip, a base portion adjacent said base, and one or more backset portions between the undercut edge-segment, and wherein said one or more basket portions, said tip portion and said base portion are generally parallel.

In another embodiment the one or more undercut edge-segment is provided by a notch or scallop recess in said edge-face.

The invention also provides a card roll, eg. a doffer or worker, clothed with card clothing according to the invention, and to a card including one or more such rolls.

BRIEF DESCRIPTION OF THE DRAWINGS

The invention will now be further described, by way of example only, with reference to the accompanying drawings, in which.

DESCRIPTION OF PREFERRED EMBODIMENTS

The tooth of a conventional doffer wire has an inside or re-entry inclined edge-face so as to define an overall overhang shape. The inventive concept stems from a realisation that the effectiveness of doffer wire can be significantly increased by making the inside or re-entry edge-face of the tooth, ie the edge-face under the overhang, as parallel as possible to the base of the wire. Prima facie, this involves forming the teeth as highly elongated highly obtuse elements which will improve the grip on the fibre during all stages of transfer from the swift to the doffer.

Figure 1:
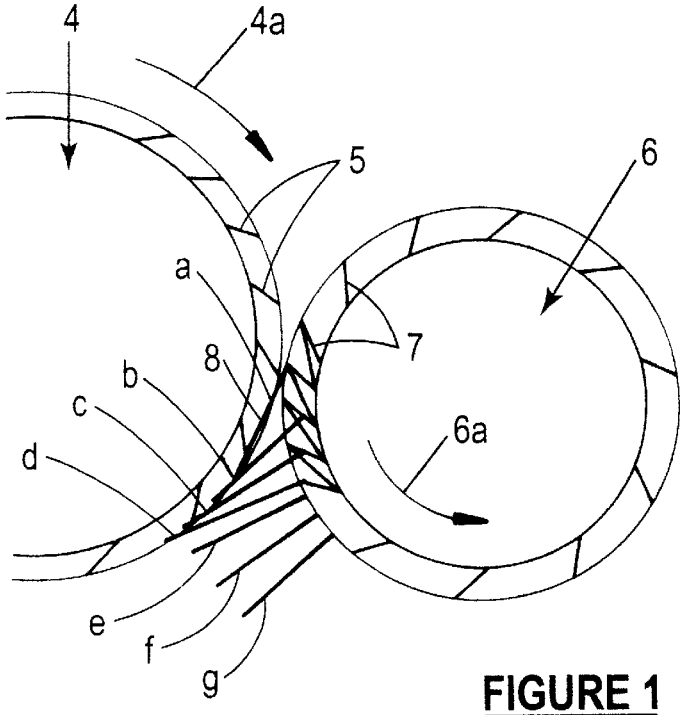
FIGURE 1 PRIOR ART
FIG. 1 illustrates the successive stages in the transfer of a fibre from a swift to a doffer, and is discussed in detail under "background art" above.
Figure 2:
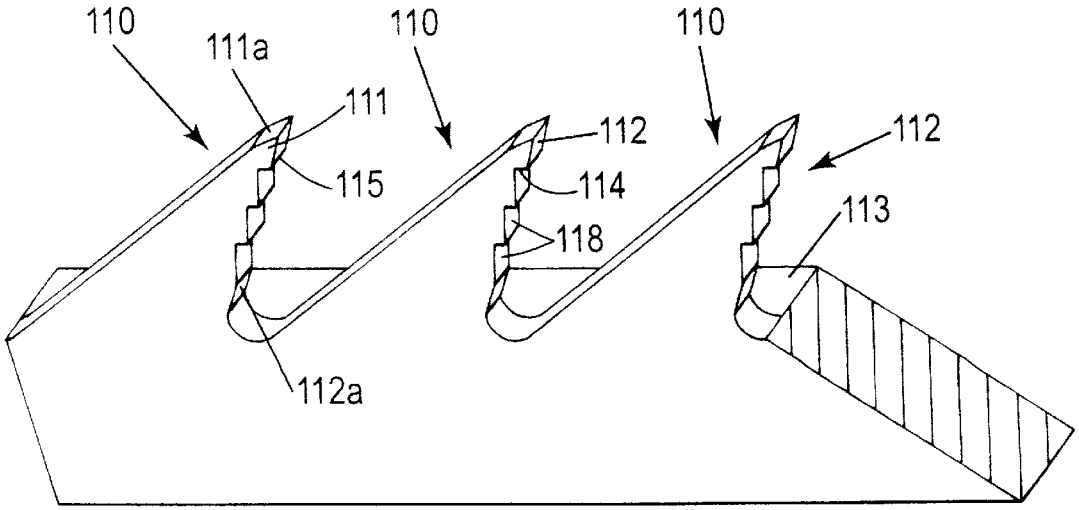
FIG. 2 is a magnified isometric view of three adjacent teeth of a profile wire according to a first embodiment of the invention, suitable for use as a doffer wire.
Figure 3:
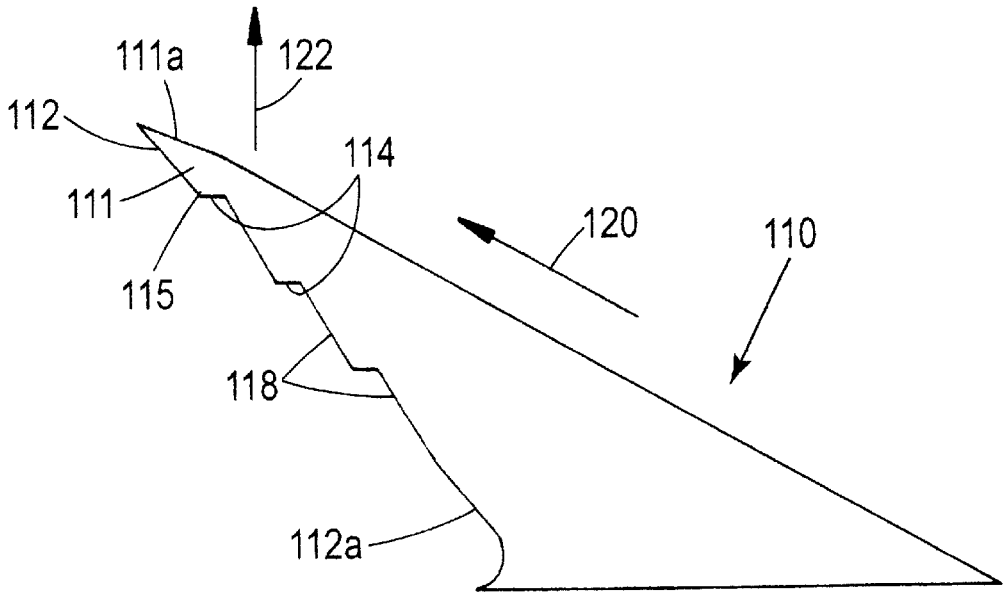
FIG. 3 is a side elevational diagram of one of the teeth shown in FIG. 2.

However, this elongate profile is not the most practical because, firstly, the teeth may be too slender to be sufficiently robust, and, secondly, there is a large reduction in the space available to accommodate the collected fibre. The present invention addresses this difficulty but maintains the essential concept by proposing that one or more, and preferably a plurality of, undercut edge-segments, preferably parallel to the base and longitudinal dimension of the wire, be formed on the inside or re-entry edge-face of each tooth. A simple embodiment of this approach is illustrated in FIGS. 2 and 3. FIG. 2 depicts a 3-tooth segment of profile wire, suitable for use as a doffer wire, in which the inside edge-face 112 of each tooth 110 is punched to provide a small dimension stepped profile consisting of three steps 114 and backset portions or risers 118. Steps 114 provide undercut edge-segments, and are generally flat and parallel to wire base 113, and to the longitudinal dimension of the wire. It is believed that this stepped profile counters the tendency for the fibres to slip off the tooth during the critical stages of doffing, eg. at position c in FIG. 1. It should be noted that the steps 114 will not interfere with stripping of the doffer itself provided the angle of the step is such that the resultant undercut does not form a hook that can trap fibre.

The arrow 120 in FIG. 3 indicates the direction of the stripping motion (whereas arrow 122 is the general direction of pull on the fibre by the swift). It should be noted, however, that increasing the angle of the step will increase the holding angle of the wire and for some specialist uses, the advantages of this may outweigh the greater difficulties for stripping.

The tip region 111 is slightly truncated on top as illustrated at 111*a*. Each of the risers 118 is angled to the lie of the original inclined edge-face 112, which remains unchanged at 112*a* adjacent base 113. In this way, the outer extremity of each step 115 remains on the line of the original edge-face 112. Riser 118 may be normal to base 113 but is preferably at a small angle to edge-face 112.

One possible difficulty with the profile illustrated in FIGS. 2 and 3 is that the vertical portions, ie. risers 118, between the steps, may increase the resistance to pick up of a fibre from the swift. This follows because the force required to push the fibre down the more steeply inclined risers 118 is greater than for the normal tooth. To avoid this difficulty and ensure unimpeded collection of fibre, the modified embodiment 210 shown in FIG. 4 has the risers or backset portions 218 parallel with the lie of the original edge-face 212. With this arrangement, it is preferable that the successive undercut edge-segments or steps 214 increase in separation in a direction away from tip 211. Without this, the thickness of the tooth may be significantly compromised towards the tip, potentially shortening its working life. It will of course be appreciated that the exact profile of the inside edge-face can be optimised by careful design, and that many different profiles are possible within the concept of the invention.

In another variation, the steps may be successively deeper, ie wider longitudinally of the wire.

Figure 4:
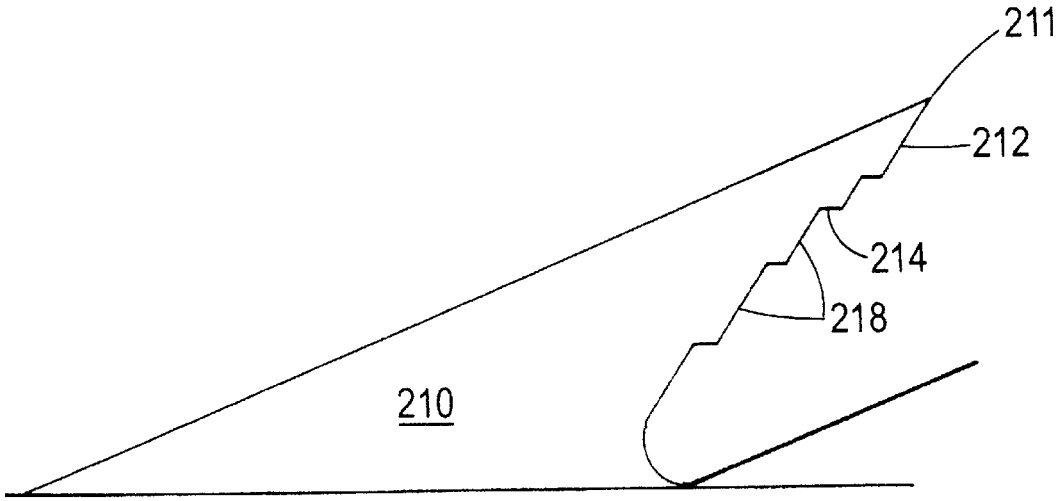
FIGS. 4 to 6 are views similar to FIG. 3 of respective alternative embodiments.

The profile of FIG. 4 has the advantage that it maximises both the collection and retention of fibre by the doffer. Alternative technologies, such as serrated wire or roughening the inside face by abrasion or the deposit of grit-like particles, do not provide a similar combination of benefits. The disadvantage is that since it is just as difficult for fibres to slide down the pins as up, fibres will tend to concentrate at the tips of the pins impeding further transfer of fibre to the doffer. This disadvantage is clearly avoided by the profiles of FIGS. 3 and 4.

Figure 5:
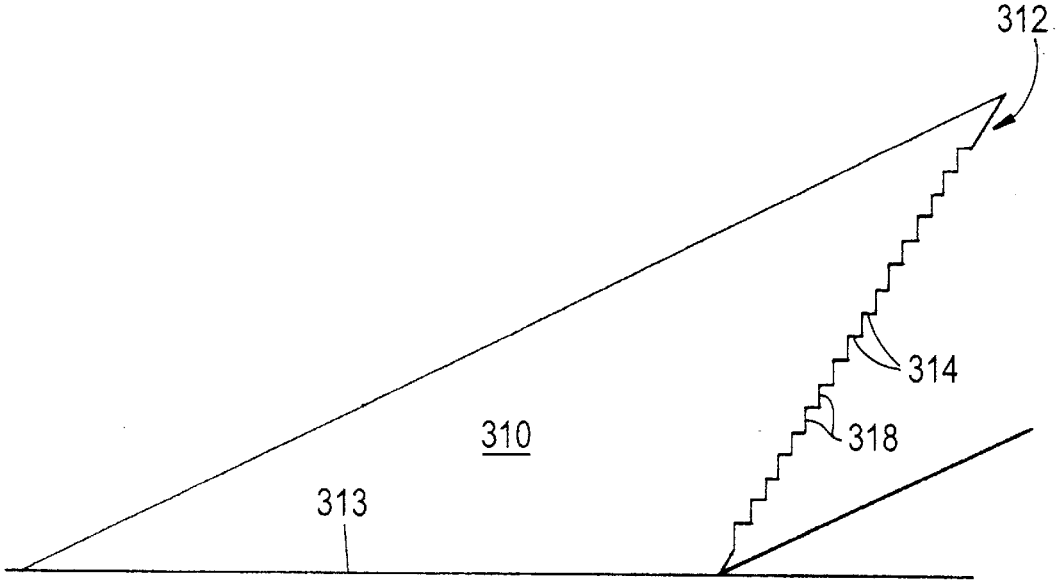

Each of the embodiments depicted in FIGS. 2 to 4 has three steps 114, 214. FIG. 5 illustrates an alternative design 310 in which the front edge 312 is punched to provide multiple close-spaced steps 314 separated by vertical (ie normal to the surface of base 313) risers 318. Although this design provides multiple undercuts to catch fibres, it is likely that about three steps is sufficient. While studies have shown that fibre density at doffer transfer nips is around one per tooth, which suggests that only one or two steps is necessary, the fibre density can greatly vary locally: if a given tooth had only one or two steps 314, fibres may not be held because of insufficient step space.

Figure 6:
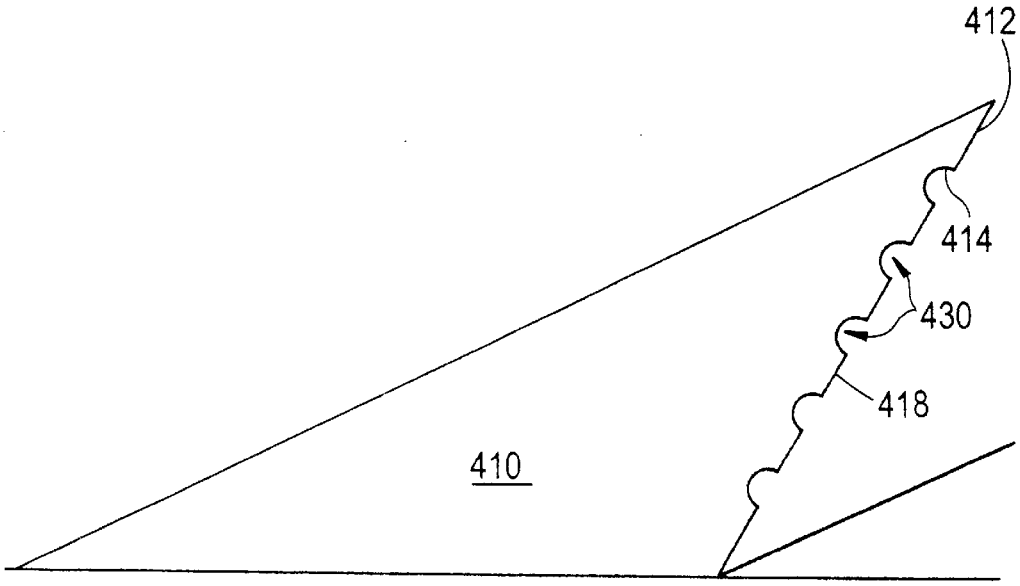

A further embodiment of profile-wire tooth 410 is illustrated in FIG. 6. Here, the undercut edge-segments 414 are provided by a series of punched out notches or scallop recesses 430 along inside edge-face 412. It will of course be understood that the generally semicircular shape of the notches 430 depicted in FIG. 6 is simply a matter of convenience and that many other shapes may be possible. Preferably, there is some portion of the undercut that is substantially horizontal or parallel to the base and longitudinal direction of the wire. The angle of the risers 418 also needs to be optimised to provide for the efficient collection of fibre.

Figure 7:
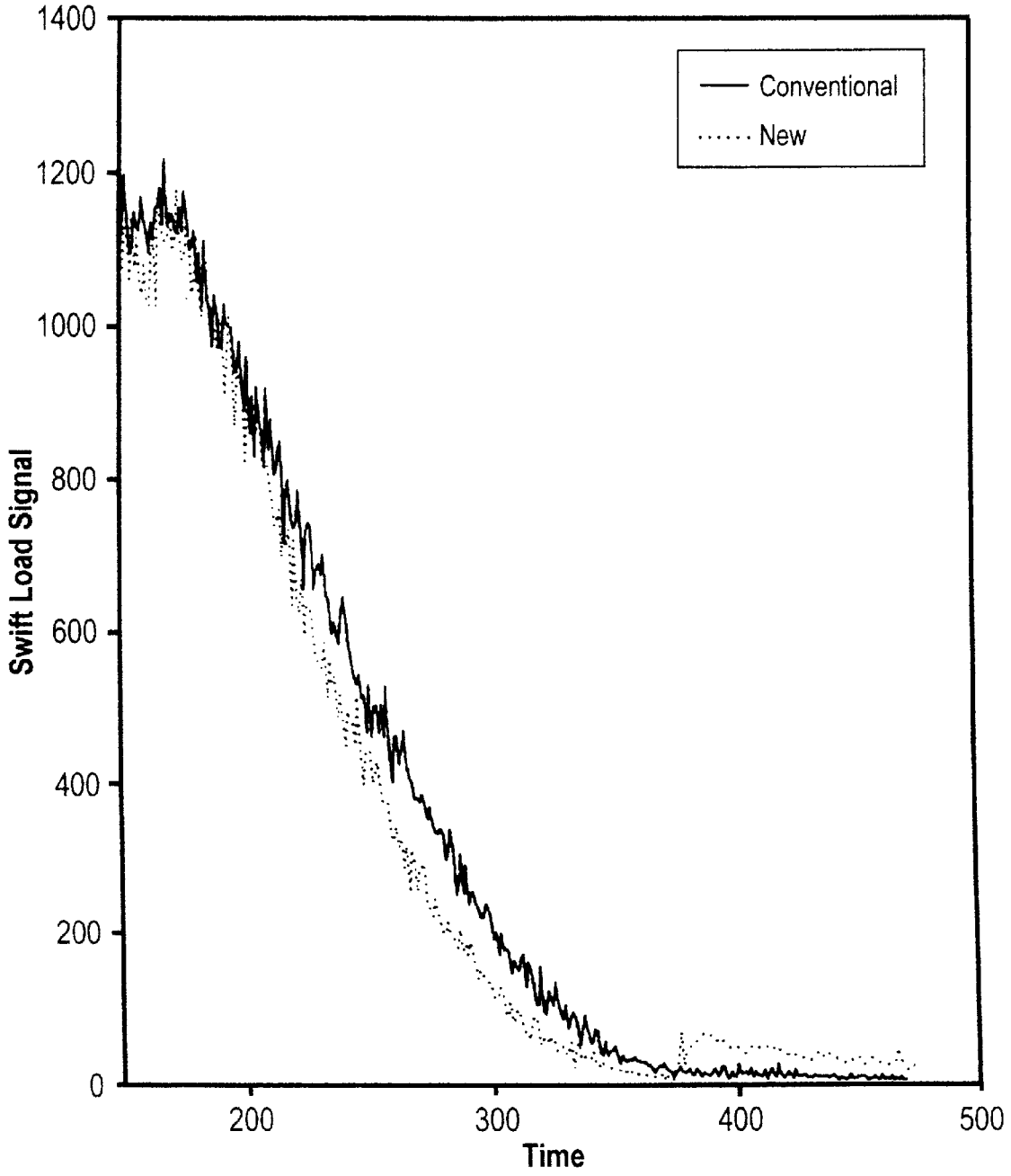
FIGS. 7 and 8 are graphs depicting the performance of doffer wire of the form illustrated in FIGS. 2 and 3.

Initial trials have indicated that the benefits of the wire profile of the invention are most evident at low swift-doffer draft, ie relatively higher doffer speeds. This arises because, whereas at higher rotational speeds fibres slip off conventional doffer wire teeth back onto the swift, the undercuts of the invention facilitate retention of the fibre and so reduce strip-back off the roller, ie increase the efficiency of transfer. In small-scale experiments with wire having the profile of FIGS. 2 and 3, the .transfer efficiency was estimated to be about 20% higher than that of a control conventional wire, as indicated by a measured faster rate of decay of fibre on the swift. This effect is illustrated in the graph of FIG. 7.

Figure 8:
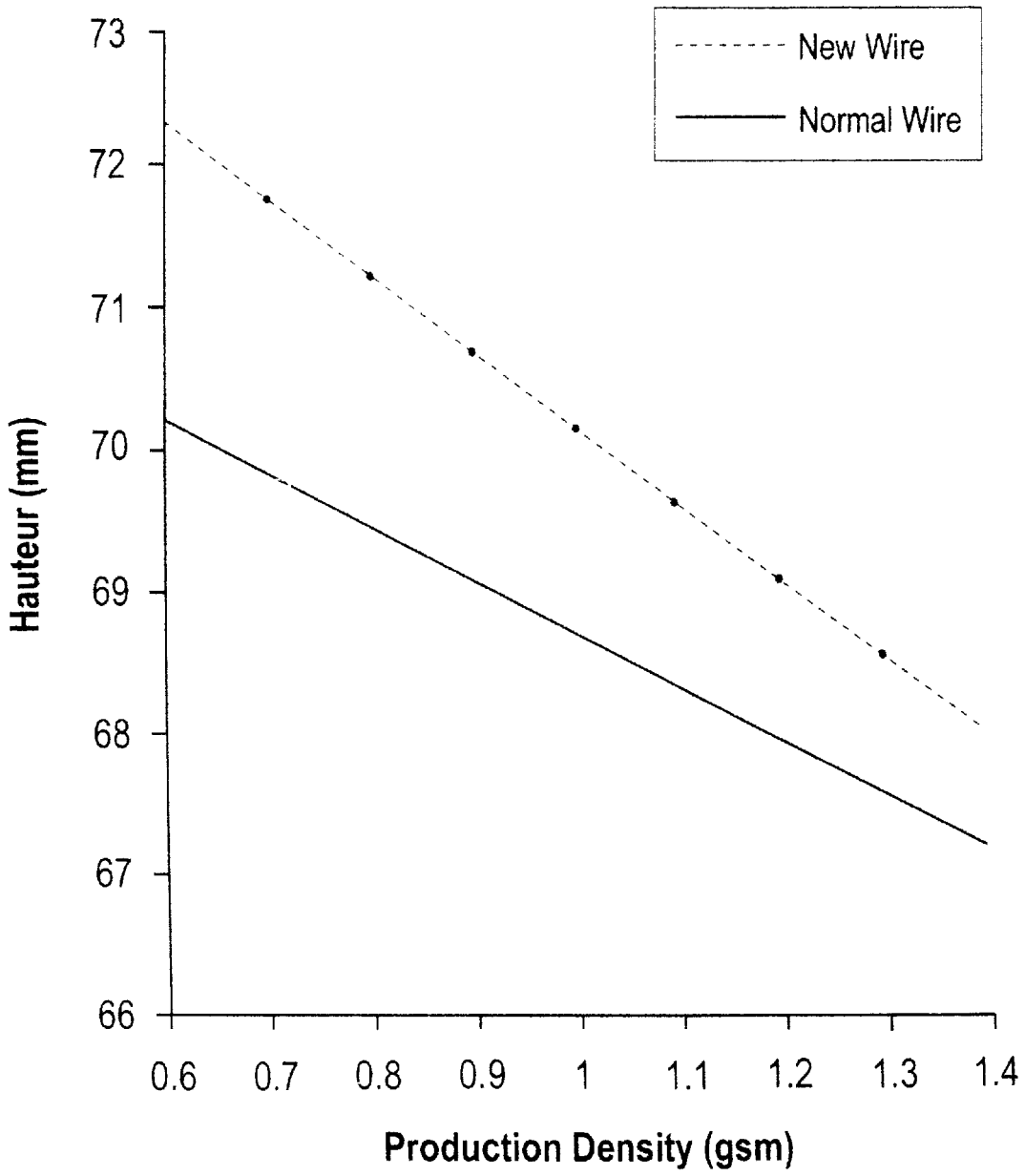

There was a corresponding observed increase in hauteur, illustrated in FIG. 8, reflecting low retention on the swift and reduced fibre breakage.

The increased efficiency of the inventive wire can be used in two ways: to deliver either an increase in hauteur or an increased production rate. In other words, topmakers can achieve either a longer wool or a higher production rate.

Another way in which benefit might be derived from the invention is to reduce the doffer diameter from conventional values. For example, for worsted cards with single doffers, the diameter of the doffer is typically 1000 mm. It is thought that, by adopting doffer wire according to the invention, the diameter might be reduced to 300 mm or so. There would also be a similar reduction for double-doffer cards.

Although the discussion above has been primarily in relation to doffers, the illustrated or other suitable embodiments of profile wire could also be used in metallic clothing for workers, but in that case there are some other options that could be adopted. Firstly, since there are many more workers on a card, there is the option of grading the extent of the grip on the fibre through the card. This could be done simply by, eg, starting or finishing with workers wrapped with the new wire; various mixes of conventional and new wire are also possible.

The use of the wire is not confined to worsted systems. It may also find use in non-woven carding, especially in those circumstances where neps are a significant problem or the coefficient of friction of the fibre is very low, eg in the carding of PTFE (teflon) fibres. The invention could also be applied to cotton carding, where the invention may be able to displace the practice of automatic doffer wire sharpening to prevent premature dislodgment of the fibre mass from the bottom of the doffer roller.

Profile wire according to the invention could be manufactured by substantially conventional means eg by stamping initially uniform wire on the run.

What is claimed is:

1. Card clothing comprising a strip of profile wire having a base and a plurality of longitudinally aligned teeth each having an overhanging tip and a leading edge-face under the overhanging tip, wherein said edge-face of each tooth includes at least one undercut edge-segment spaced along the edge-face from the tip, which undercut includes at least a portion of the undercut that is substantially parallel to the longitudinal dimension of the profile wire for holding fibers slipping up said edge-face and thereby increasing the retention of fibers by said edge-face during carding.

2. Card clothing according to claim 1, wherein there are a plurality of said edge-segments spaced from said tip and spaced apart along said edge-face.

3. Card clothing according to claim 2, wherein there are multiple said edge-segments and their spacing increases in a direction away from the tip of the tooth.

4. Card clothing according to claim 3, wherein said segment each have an extremity in the longitudinal direction of the profile wire, and these extremities of said edge segments and said tip are in alignment.

5. Card clothing according to claim 3, wherein said edge-face includes a tip portion adjacent said tip, a base portion adjacent said base, and one or more backset portions between the undercut edge-segments, and wherein said one or more backset portions, said tip portion and said base portion are generally parallel.

6. Card clothing according to claim 3, wherein each said undercut edge segment is provided by a notch or scallop recess in said edge-face.

7. Card clothing according to claim 2, wherein said edge-segments each have an extremity in the longitudinal direction of the profile wire, and these extremities of said edge segments and said tip are in alignment.

8. Card clothing according to claim 7, herein said portion of the undercut constitutes at least a major proportion of the undercut edge segment.

9. Card clothing according to claim 7, wherein each said undercut edge segment is provided by a notch or scallop recess in said edge-face.

10. Card clothing according to claim 2, wherein said edge-face includes a tip portion adjacent said tip, a base portion adjacent said base, and one or more backset portions between the undercut edge segments, and wherein said one or more backset portions, said tip portion and said base portion are generally parallel.

11. Card clothing according to claim 2, wherein each said undercut edge segment is provided by a notch or scallop recess in said edge-face.

12. Card clothing according to claim 1, wherein said portion of the undercut constitutes at least a major proportion of the undercut edge segment.

13. Card clothing according to claim 1, wherein said at least one undercut edge-segment is provided by a notch or scallop recess in said edge-face.

14. Card clothing according to claim 1, provided on a card roll.

15. Card clothing according to claim 1, provided on a doffer.

16. Card clothing according to claim 1, provided on a worker.

17. Card clothing according to claim 1, provided on a roll of a textile card.

18. Card clothing according to claim 1, provided on a card roll.

19. Card clothing according to claim 1, provided on a doffer.

20. Card clothing according to claim 1, provided on a worker.

21. Card clothing according to claim 1, provided on a roll of a textile card.

* * * * *